US007310495B2

(12) United States Patent
Kayama et al.

(10) Patent No.: US 7,310,495 B2
(45) Date of Patent: Dec. 18, 2007

(54) IMAGE FORMING APPARATUS

(75) Inventors: Naonori Kayama, Yokohama (JP); Takashi Kuwata, Shizuoka-Ken (JP); Junichi Sekiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 11/249,631

(22) Filed: Oct. 14, 2005

(65) Prior Publication Data

US 2006/0181004 A1 Aug. 17, 2006

(30) Foreign Application Priority Data

Oct. 29, 2004 (JP) ..... 2004-315924
Oct. 5, 2005 (JP) ..... 2005-292662

(51) Int. Cl.
*G03G 15/00* (2006.01)
*B41J 13/00* (2006.01)
*B65H 29/00* (2006.01)

(52) U.S. Cl. ..... 399/406; 271/161; 271/188; 271/209; 400/625; 400/637.1

(58) Field of Classification Search ..... None
See application file for complete search history.

(56) References Cited

U.S. PATENT DOCUMENTS 5,316,286 A * 5/1994 Takimoto ..... 271/182
5,404,805 A 4/1995 Fujimoto et al. ..... 101/118
5,765,826 A 6/1998 Isoda et al. ..... 271/162
6,181,908 B1 * 1/2001 Leemhuis et al. ..... 399/406
6,371,479 B1 * 4/2002 Osaka et al. ..... 271/186
6,527,267 B1 3/2003 Kuwata et al. ..... 271/9.13
6,643,480 B2 11/2003 Kuwata et al. ..... 399/107
6,988,730 B2 1/2006 Fukatsu et al. ..... 271/306
6,997,456 B2 2/2006 Fukatsu et al. ..... 271/306
2006/0082047 A1 4/2006 Fukatsu et al. ..... 271/220

FOREIGN PATENT DOCUMENTS

JP 04045053 A * 2/1992
JP 09227007 A * 9/1997
JP 2000229760 A * 8/2000
JP 2001335220 A * 12/2001
JP 2002003050 A * 1/2002
JP 2002-226121 8/2002
JP 2002226121 A * 8/2002
JP 2004098601 A * 4/2004

* cited by examiner

*Primary Examiner*—Daniel J. Colilla
*Assistant Examiner*—N. Ha
(74) *Attorney, Agent, or Firm*—Fitzpatrick, Cella, Harper & Scinto

(57) ABSTRACT

The present invention provides an image forming apparatus that can perform stable sheet conveyance, regardless of whether a sheet processing apparatus is connected thereto. The image forming apparatus can be connected to a sheet processing apparatus that performs post processing on each conveyed sheet. The image forming apparatus includes: a pair of discharge rollers that are located at the discharge outlet of the image forming main body for sheet conveyance, and have rotational members arranged so as to alternately face both sides of each sheet in the direction perpendicular to the sheet conveying direction; and an upper discharge roller holding member that changes the center distance between the discharge rollers from a first center distance observed when the sheet processing apparatus is not connected to the image forming main body to a second center distance observed when the sheet processing apparatus is connected to the image forming main body to convey a sheet to the sheet processing apparatus.

3 Claims, 7 Drawing Sheets

IMAGE FORMING APPARATUS

BACKGROUND OF THE INVENTION

1. Field of the Invention

The present invention relates to an image forming apparatus to which a sheet processing apparatus that performs post processing on each sheet having an image formed thereon can be connected.

2. Description of the Related Art

Japanese Unexamined Patent Publication No. 2002-226121 discloses a structure that lifts up the center portion of each sheet to be discharged from a printer, and has a pair of discharge rollers with rotational members alternately arranged in the rotational axis direction, so as to increase the sheet stackability. This document also discloses a structure that has convex portions forming such a wave-like portion that each sheet cannot easily be folded in the sheet conveying direction. With this structure, each sheet is discharged onto a stacking tray, while being given the sheet stiffness.

Staple stackers are known as sheet processing apparatuses for image forming apparatuses such as printers and copying machines. A staple stacker is provided on a side surface on the sheet discharge outlet side of an image forming main body. Such a staple stacker straightens the end portions of sheets supplied one by one through the sheet discharge outlet of the image forming main body, and performs post processing such as stapling on the sheets.

However, when the sheet processing apparatus is connected to the image forming apparatus disclosed in the above document, each sheet discharged from the image forming main body is conveyed to the sheet processing apparatus, with the same stiffness of the sheet as that in the case of being discharged on the stacking tray. Accordingly, each sheet enters the conveying path of the sheet processing apparatus, while being in such an insecure position as to cause high conveyance resistance in the conveying path. As a result, the top ends of the sheets often cause jamming in the conveying path, and reduce the reliability of the image forming apparatus.

Further, so as to convey each sheet in a stable state to the sheet processing apparatus, it is necessary to add a guide member to secure the position of each sheet in the conveying path between the image forming apparatus and the sheet processing apparatus. With such a guide member, however, the sheet processing apparatus becomes larger in size, and the production costs also increase.

SUMMARY OF THE INVENTION

In light of the above, therefore, it is an object of the present invention to provide an image forming apparatus that can perform stable sheet conveyance, regardless of whether a sheet processing apparatus is connected thereto.

To achieve above-mentioned object, the present invention provides an image forming apparatus to which a sheet processing apparatus that performs post processing on each sheet discharged from the main body of the image forming apparatus can be connected, the image forming apparatus comprising: a discharge portion which discharges each sheet from the main body of the image forming apparatus; and a curvature providing portion which is located in the discharge portion and gives curvature to the sheet to be discharged, the curvature being directed in a direction perpendicular to the sheet discharging direction, the curvature providing portion being engaged with an engaging portion provided to the sheet processing apparatus, thereby reducing the curvature to be given to the sheet.

In addition, to achieve the object, the present invention provides an image forming apparatus to which a sheet processing apparatus that performs post processing on each sheet discharged from the main body of the image forming apparatus can be connected, the image forming apparatus comprising: a discharge portion which discharges each sheet from the main body of the image forming apparatus; and a curvature providing portion which is located in the discharge portion and gives curvature to the sheet to be discharged, the curvature being directed in a direction perpendicular to the sheet discharging direction, the curvature providing portion being designed to reduce the curvature to be provided to the sheet, as driving force is transmitted from the sheet processing apparatus through engagement between a driving force transmission unit provided in the main body of the image forming apparatus and a driving force transmission unit provided in the sheet processing apparatus.

In accordance with the present invention, stable sheet conveyance can be performed, regardless of whether a sheet processing apparatus is connected to the image forming apparatus.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1A:
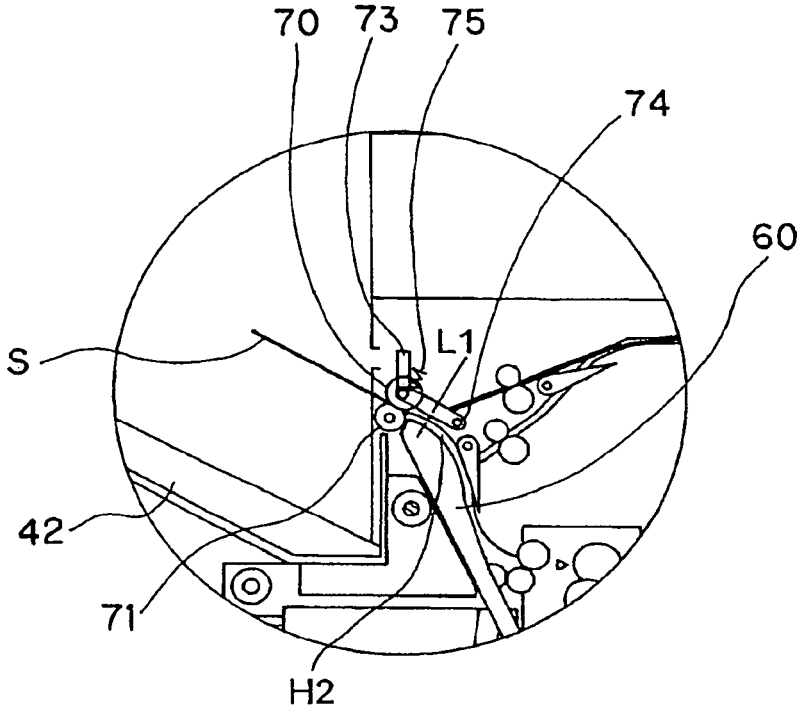
FIG. 1A is a vertical cross-sectional view of an image forming apparatus, with a sheet being discharged.
Figure 1B:
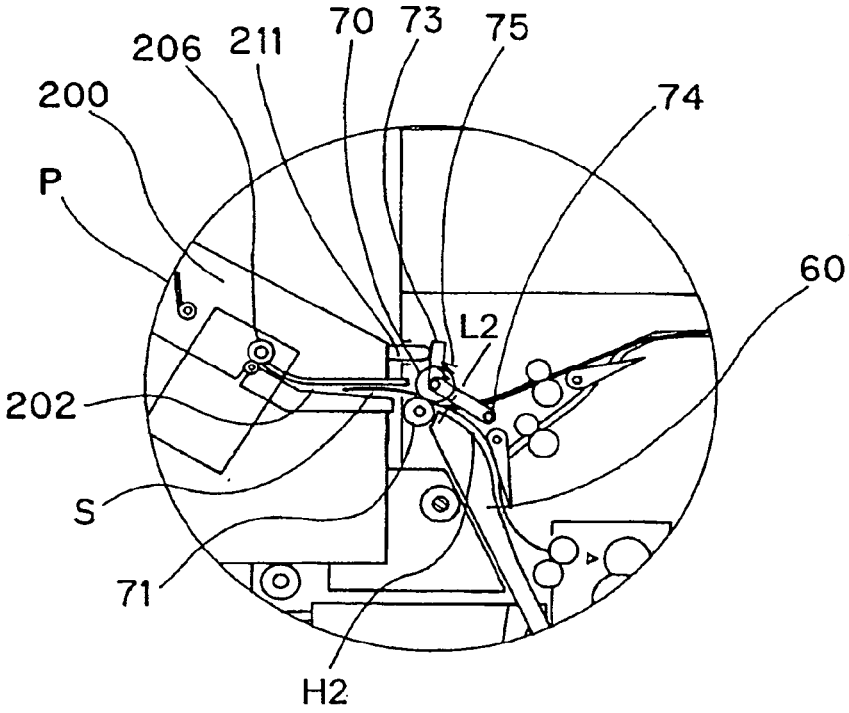
FIG. 1B is a vertical cross-sectional view of the image forming apparatus, with a sheet entering the sheet processing apparatus.

The following is a description of embodiments of the present invention, with reference to the accompanying drawings. In the drawings illustrating the embodiments, like components are denoted by like reference numerals. The sizes, materials, shapes, and relative locations of the components of the following embodiments do not limit the scope of the invention, unless otherwise specifically mentioned. Each of the embodiments concerns an image forming apparatus as typified by a laser-beam multifunction printer, and a sheet processing apparatus that can be connected to the image forming apparatus.

First Embodiment (Overview of Image Forming Apparatus)

Figure 6:
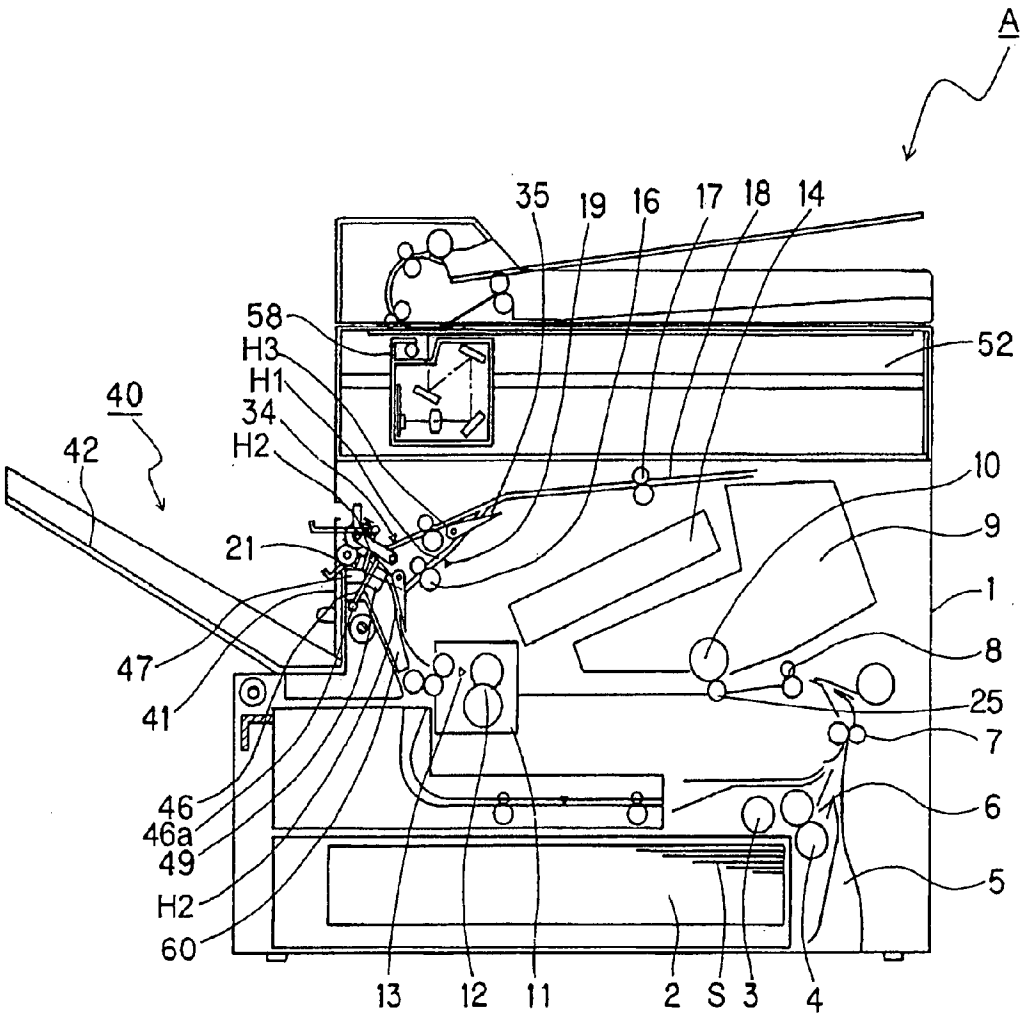
FIG. 6 is a vertical cross-sectional view of an image forming apparatus.

FIG. 6 is a schematic cross-sectional view of an image forming apparatus in accordance with a first embodiment of the present invention. As shown in FIG. 6, the image forming apparatus A includes an image forming main body 1, an image reader 52, a feeder cassette 2, a feeding roller 3, a pair of separation rollers 4, conveying paths 5 and 6, a pair of conveyance rollers 7, a resist roller 8, an image formation processing unit 9 (hereinafter referred to as the cartridge), a photosensitive drum 10, a fixing unit 11, a pair of fixing discharge rollers 12, a fixing discharge sensor 13, and a image forming write scanner 14. A discharge tray 40 is provided on a side surface of the image forming main body 1.

(Image Forming Operation)

Sheets S placed in the feeder cassette 2 are picked up by the feeding roller 3, and are separated one by one by the pair of separation rollers 4. While passing through the conveying path 6, each sheet S is conveyed to the resist roller 8 by the pair of conveyance rollers 7.

The image forming apparatus A drives the write scanner 14 that emits laser beams converted from an image signal, and forms a latent image on the photosensitive drum 10 contained in the cartridge 9. The latent image formed on the photosensitive drum 10 is developed as a toner image by a development unit (not shown).

The sheet S conveyed to the resist roller 8 is sent to a transfer unit in synchronization with the image forming operation, and a transfer device 25 transfers the toner image from the photosensitive drum 10 onto the sheet S.

The sheet S having the toner image transferred thereon is conveyed to the fixing unit 11, and are heated and pressured by the pair of fixing discharge rollers 12, thereby fixing the toner image on the sheet S.

In the image forming apparatus A in accordance with the first embodiment, two discharge paths are provided to discharge the sheets S onto the discharge tray 40. One of the discharge paths is a first conveying path H1 through which each sheet S is conveyed from the pair of fixing discharge rollers 12 to the write scanner 14, and is reversed prior to discharging. The other one of the discharge paths is a second conveying path H2 through which each sheet S is discharged directly onto the discharge tray 40.

The switching between the first conveying path H1 and the second conveying path H2 is carried out by an FD (face-down)/FU (face-up) flapper 21 that is provided on the downstream side of the pair of fixing discharge rollers 12.

The sheet S that is conveyed into the second conveying path H2 through the switching by the FD/FU flapper 21 is discharged directly onto the discharge tray 40 via a pair of discharge rollers 70 and 71. In this case, the sheet S has an image-formed surface facing upward, thereby performing face-up discharge.

The sheet S that is conveyed into the first conveying path H1 through the switching by the FD/FU flapper 21 passes through a pair of merging rollers 16 that are provided in the middle of the first conveying path H1 on the downstream side of the FD/FU flapper 21, and reaches a pair of reverse rollers 17 that are provided above the write scanner 14.

For sending the sheet S to a third conveying path H3 (described later), the pair of reverse rollers 17 have a structure that can reverse the sheet conveying directions. A lead-in conveying path 18 is further provided on the downstream side of the pair of reverse rollers 17. The end of the lead-in conveying path 18 has such a shape that each sheet passes above the cartridge 9 and the end of each sheet cannot stick out of the apparatus. A sheet sensor 19 that detects the existence of each sheet is provided in the middle of the first conveying path H1.

The sheet H that has reached the pair of reverse rollers 17 is conveyed toward the third conveying path H3 by virtue of a reverse flapper 35 that is provided at the junction of the first conveying path H1 and the third conveying path H3 extending to the pair of discharge rollers 70 and 71. Here, the pair of discharge rollers 70 and 71 are provided at the discharge outlet of the image forming main body 1, so as to convey each sheet to the outside of the apparatus. The pair of discharge rollers 70 and 71 are also formed by arranging rotating members alternated on the upper surface and the lower surface of each sheet in the direction crossing the sheet conveying direction.

Each sheet S is discharged onto the discharge tray 40 via the first conveying path H1 and the third conveying path H3. In such a case, the sheet S has an image-formed surface facing down, which is so-called "face-down discharge".

(Sliding Movement of the Discharge Tray)

Figure 7:
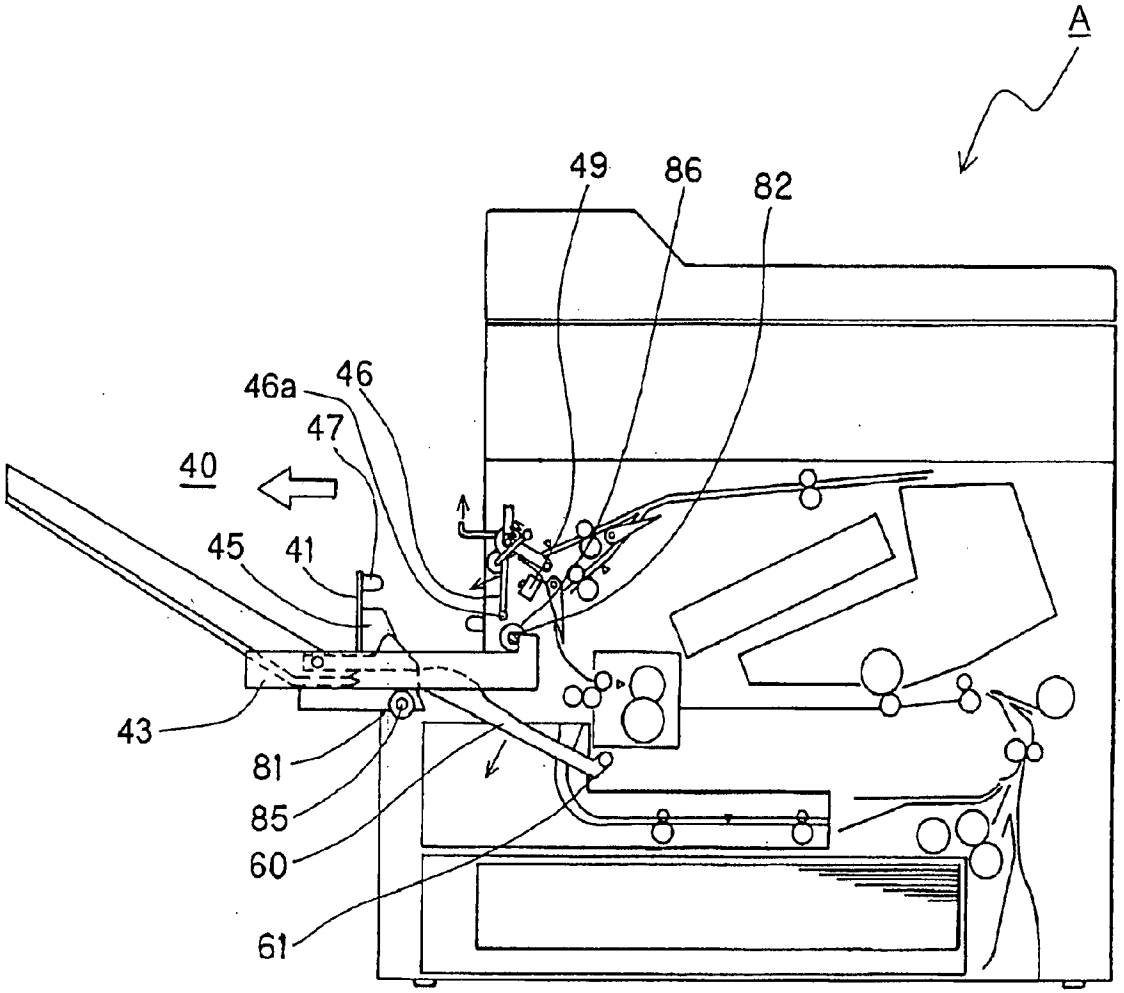
FIG. 7 is a schematic vertical cross-sectional view of the image forming apparatus to which a discharge tray is not attached.

Next, the sliding movement of the discharge tray 40 is described. FIGS. 6 and 7 illustrate the situation in which the discharge tray 40 is slid.

In the image forming apparatus illustrated in FIG. 6, the discharge tray 40 is attached to the apparatus. The discharge tray 40 shown in FIG. 6 includes a stacking wall 41, a tray 42, a rail 43 fixed on the backside of the tray 42, an outer cover 44 (not shown), and a flip-up member 45.

The rail 43 is a stick-like rail provided for the discharge tray 40, and is incorporated into the image forming main body 1. The rail 43 slidably supports the weight of the discharge tray 40 in the rail horizontal direction, by virtue of rollers 81 and 82 that are rotatably provided in relation to shafts 85 and 86 provided on the frame of the image forming main body 1.

An FU guide 60 that forms the outer guide of the second conveying path H2 rotates counterclockwise by its own weight, with a rotation center 61 being the center of the rotation. The FU guide 60 is secured at the shown location, as the flip-up member 45 of the discharge tray 40 is brought into contact with the FU guide 60.

A protrusion 47 is also provided to the discharge tray 40. A discharge tray sensor member 46 is rotatably provided, with a rotation center 46*a* being the center of the rotation. The discharge tray sensor member 46 is also energized counterclockwise by a spring. When the discharge tray 40 is located in a first position in which sheets discharged during a regular operation of the image forming apparatus A are stacked, the protrusion 47 presses the discharge tray sensor member 46. As a result, the discharge tray sensor member 46 rotates clockwise and presses a discharge tray switch 49. Accordingly, the discharge tray switch 49 is turned ON, and then detects that the discharge tray 40 is located in the first position with respect to the image forming main body 1.

In the image forming apparatus illustrated in FIG. 7, the discharge tray 40 is pulled out.

When a user is to deal with a jammed sheet S remaining in the second conveying path H2, the user moves the discharge tray 40 to a second position by pulling the discharge tray 40 with its handle. In the second position, the discharge tray 40 is out of the image forming main body 1.

In synchronization with the sliding movement of the discharge tray 40, the flip-up member 45 retreats to the left, and the FU guide 60 rotates about the rotation center 61. Accordingly, the second conveying path H2 is opened, so that access is allowed to the sheet S.

When the discharge tray 40 is pulled out and is located in the second position, the protrusion 47 is separated from the discharge tray sensor member 46. The discharge tray sensor member 46 is therefore rotated counterclockwise by a spring to separate from the discharge tray switch 49. Accordingly, the discharge tray switch 49 is turned OFF, and the image forming main body 1 detects that the discharge tray 40 is pulled out and is located in the second position.

When the user ends the handling of the jammed sheet S, the user slides the discharge tray 40 to the right. The FU guide 60 rotates clockwise as the flip-up member 45 is brought into contact with the FU guide 60. When the discharge tray 40 is slid to the first position, the FU guide 60 forms the second conveying path H2.

With the above structure, the second conveying path H2 is opened and closed in conjunction with the sliding movement of the discharge tray 40. Thus, a user can easily deal with a jammed sheet.

As shown in FIG. 1A, when the image forming main body 1 to which a sheet processing apparatus is not connected is to discharge the sheet S onto the discharge tray 40, the center distance between the upper discharge roller 70 and the lower discharge roller 71 is set to a first center distance L1 in the first embodiment. Here, the "center distance" is the distance between the upper discharge roller axis 70*b* and the lower discharge roller axis 71*b*.

Figure 2A:
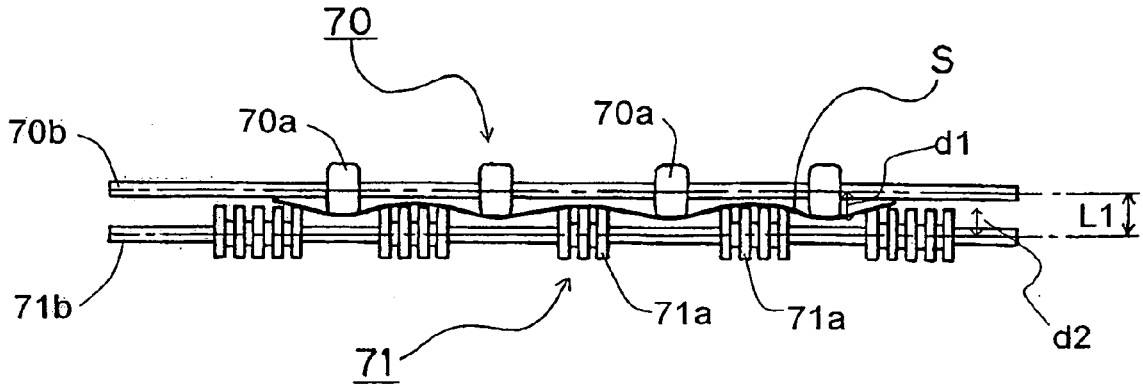
FIG. 2A illustrates the sheet shape in accordance with the center distance between two discharge rollers.

More specifically, as shown in FIG. 2A, rotational members 70*a* and 71*a* provided to the upper discharge roller 70 and the lower discharge roller 71 are alternately arranged in the direction of the rotation axis. With the radiuses of the rotational members 70*a* and 71*a* being d1 and d2, the first center distance L1 is to be smaller than d1+d2. By doing so, the sheet S that is to pass between the discharge rollers 70 and 71 having the rotational members 70*a* and 71*a* overlapped and is to be discharged onto the discharge tray 40, is given stiffness to form a wave-like shape in the crossing direction to the sheet conveying direction. Accordingly, the shape of the sheet S is steadied with respect to the discharge tray 40 at the time of discharging, and sheets S are stacked one by one in a predetermined position on the discharge tray 40. Thus, the sheet stackability can be increased.

(Situation in which Sheet Processing Apparatus is Connected to Image Forming Apparatus)

The following is a description of a case where the discharge tray 40 included as standard equipment in the image forming apparatus A is detached from the image forming main body 1, and a sheet processing apparatus is connected to the image forming apparatus A.

Figure 3:
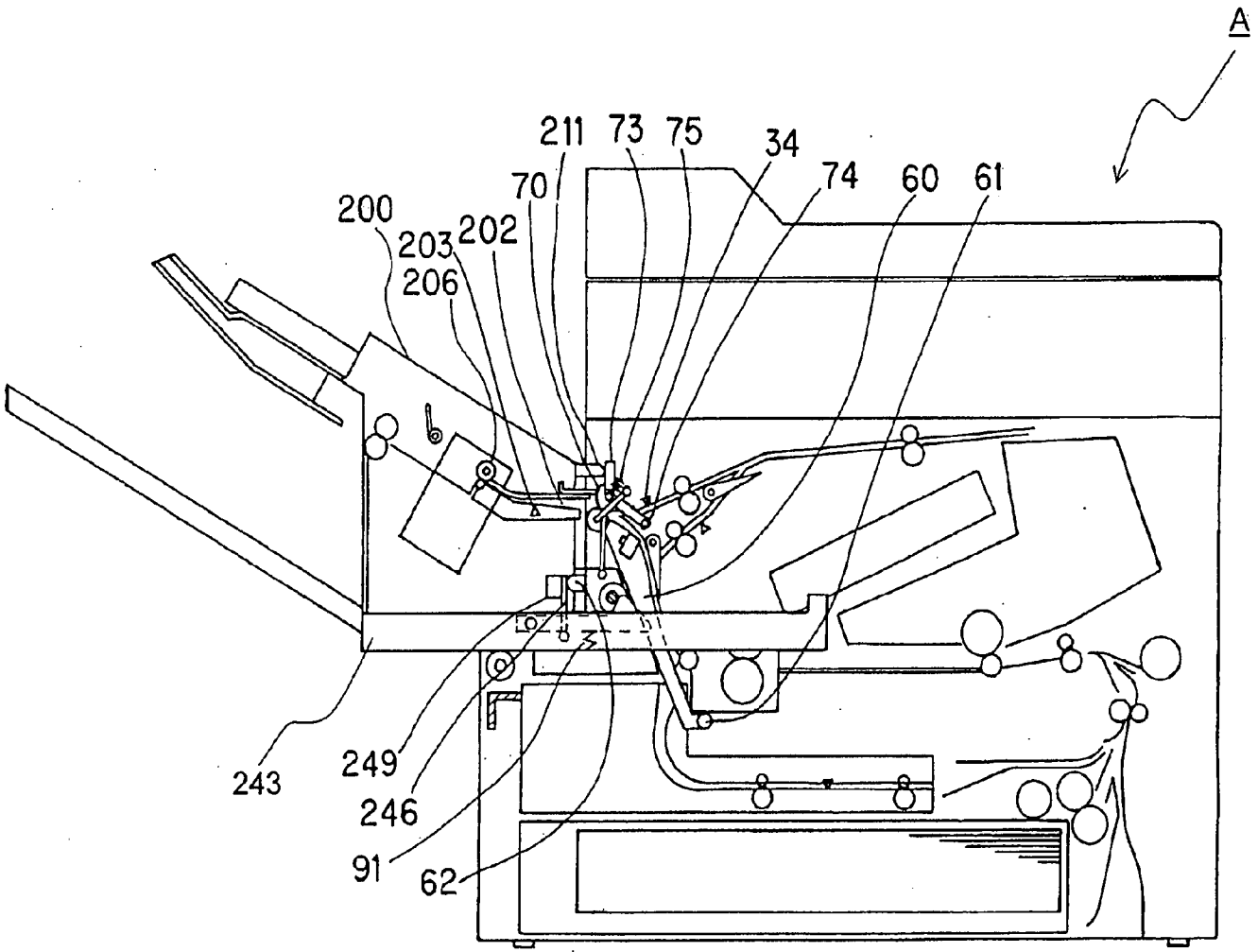
FIG. 3 is a schematic vertical cross-sectional view of an image forming apparatus and a sheet processing apparatus in accordance with a first embodiment of the present invention.

FIG. 3 illustrates the image forming apparatus A to which a staple stacker 200 that can straighten and bind sheets is connected as an example of a sheet processing apparatus.

As shown in FIG. 3, the discharge tray 40 is slid to the furthest slidable position, and is detached from the image forming main body 1.

The staple stacker 200 has a rail 243 that is the same as the rail 43 provided for the discharge tray 40. A flip-up member 247 that is the same as the flip-up member 45 provided for the discharge tray 40 is also provided for the staple stacker 200. Accordingly, the interface with respect to the image forming main body 1 has the same structure as the discharge tray 40.

Figure 4:
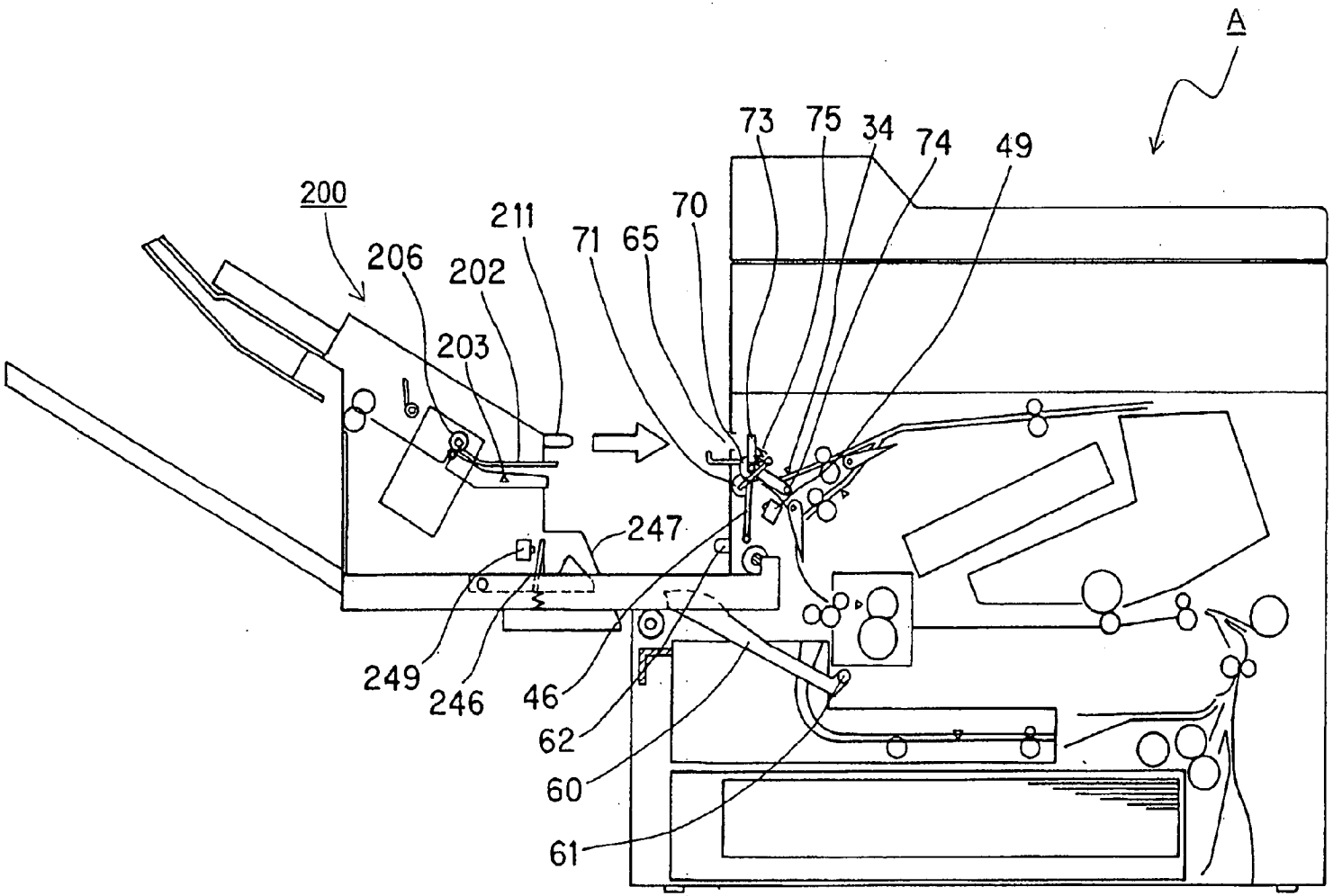
FIG. 4 is a vertical cross-sectional view of the image forming apparatus to which the sheet processing apparatus is not connected.

As shown in FIGS. 4 and 6, the interface of the staple stacker 200 to be connected to the image forming main body 1 is exactly the same as the discharge tray 40. Accordingly, the staple stacker 200 is slid to the right so as to be connected to the image forming apparatus A, which is the opposite operation to the process of detaching the discharge tray 40 from the image forming apparatus A.

A sheet processing apparatus switch 249 and a sheet processing apparatus switching member 246 are provided in the staple stacker 200. When the staple stacker 200 is not connected to the image forming main body 1, the sheet processing apparatus switching member 246 is energized clockwise by a spring.

When the staple stacker 200 is connected to the image forming main body 1, a protrusion 62 provided to the image forming main body 1 energizes the sheet processing apparatus switching member 246. Being energized, the sheet processing apparatus switching member 246 rotates counterclockwise and brings itself into contact with the sheet processing apparatus switch 249. Thus, the sheet processing apparatus switch 249 is put into an ON state.

A protrusion 211 that is provided to the exterior of the staple stacker 200 and serves as an engaging member enters an opening 65 formed in the image forming main body 1 and comes in contact with an upper discharge roller holding member 73 that serves as a curvature providing portion.

As the upper discharge roller holding member 73 rotates clockwise about a rotation center 74, the upper discharge roller 70 moves to a predetermined position. As a result, the center distance between the upper discharge roller 70 and the lower discharge roller 71 is changed to a second center distance L2 when the staple stacker 200 is connected to the image forming main body 1 and each sheet is conveyed to the staple stacker 200. More specifically, the upper discharge roller holding member 73 is activated by the protrusion 211 formed on the staple stacker 200. As the center distance between the-discharge rollers 70 and 71 is changed, the overlapping amount between the rotational members 70*a* and 71*a* provided to the upper discharge roller 70 and the lower discharge roller 71 is changed, thereby varying the extent of the sheet stiffness of each sheet that is being conveyed.

An end of a cable (not shown) is attached to the staple stacker 200. When the staple stacker 200 is connected to the image forming main body 1, the other end of the cable (not shown) is attached to the image forming main body 1. With this arrangement, electric signals can be exchanged between the staple stacker 200 and the image forming main body 1 via the cable.

A detector that can detect the cable being connected to the image forming main body 1 may further be employed to determine whether the sheet processing apparatus is connected to the image forming apparatus A. It is also possible to employ a detector that can detect communication between the image forming main body 1 and the staple stacker 200 so as to determine the connection between the sheet processing apparatus and the image forming apparatus A.

As shown in FIG. 4, for example, even when the staple stacker 200 is pulled out to the left for a jammed sheet, one end of the cable should not be separated from the image forming main body 1.

When a control portion provided in the image forming apparatus A determines that the discharge tray switch 49 is OFF, the sheet processing apparatus switch 249 is ON, and electric connection is established between the staple stacker 200 and the image forming main body 1 via the cable, the staple stacker 200 is determined to be properly connected to the image forming main body 1, and based on the fact, the control portion controls the image forming operation.

When a full-load sensor (not shown) mounted on the staple stacker 200 is determined to be OFF, the image forming main body 1 and the staple stacker 200 operate properly.

Figure 2B:
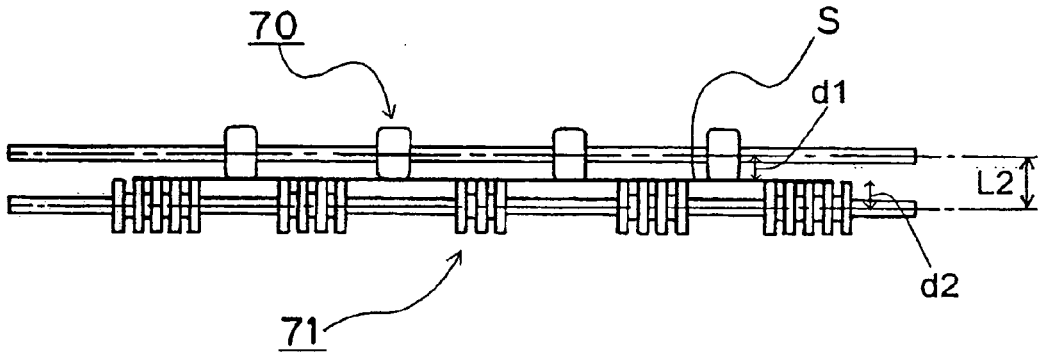
FIG. 2B illustrates the sheet shape in accordance with the center distance between the two discharge rollers.

At this point, the distance between the shafts of the upper discharge roller 70 and the lower discharge roller 71 is the second center distance L2, which is longer than the first center distance L1. Accordingly, the sheet S that passes between the discharge rollers 70 and 71, which form a discharge unit, and is conveyed to the staple stacker 200, which is the sheet processing apparatus, exhibits substantially a straight-line shape as shown in FIG. 2B. Thus, the sheet S in a fixed shape can enter a conveying path 202 with a low conveyance resistance. The staple stacker 200 then performs a series of post processing operations, in accordance with signals from a sheet-in sensor 203.

When the staple stacker 200 is detached from the image forming main body 1, the upper discharge roller holding member 73 is energized by a biasing member 75, and rotates counterclockwise about the rotation center 74. The upper discharge roller 70 then moves to the predetermined position in which the center distance changes from the second center distance L2 to the first center distance L1.

Although the center distance between the discharge rollers 70 and 71 changes when the upper discharge roller 70 moves to the predetermined position in the first embodiment, the same effect as above can be achieved by moving the lower discharge roller 71.

Also, the engaging portion is not limited to the protrusion 211 of this embodiment. For example, if a protrusion that protrudes outward is provided on the image forming main body, the engaging portion formed on the sheet processing apparatus should have such a shape that can be engaged with the protrusion provided on the image forming main body.

As described above, in accordance with the first embodiment, the center distance between the pair of discharge rollers of the image forming apparatus is changed reliably through mechanical connection of the sheet processing apparatus to the image forming apparatus. As a result, the shape of the sheet is changed so as to easily enter the conveying path of the sheet processing apparatus, and each sheet is hardly subjected to conveyance resistance. Accordingly, highly reliable conveyance can be performed when sheets are conveyed from the image forming apparatus to the sheet processing apparatus. Also, when the sheet processing apparatus is not connected to the image forming apparatus, the center distance between the pair of discharge rollers of the image forming apparatus is set so that sheets can be given the sheet stiffness suitably for the predetermined discharge tray. Thus, preferable sheet stackability can be maintained.

Also, the second center distance is set longer than the first center distance, so that the overlapped portion between the rotational members 70*a* and 71*a* provided for the upper discharge roller 70 and the lower discharge roller 71 can be reduced. Furthermore, in the case where there is the second center distance between the pair of discharge rollers, the extent of the sheet stiffness of each sheet conveyed between the pair of discharge rollers can be made smaller than the extent of the sheet stiffness of each sheet conveyed between the pair of discharge rollers in the case of the first center distance. With this arrangement, when the sheet processing apparatus is connected to the image forming main body, the frequency of defective conveyance (jamming or folding) of sheets from the image forming main body to the sheet processing apparatus can be reduced.

Also in accordance with this embodiment, there is no need to form a conveying path for correcting the position of each sheet and improving the conveyance performance in the sheet processing apparatus. Accordingly, the size of the sheet processing apparatus can be reduced. Thus, an image forming apparatus can be provided with a sheet processing apparatus that occupies only a small area and shows excellent cost performance.

Second Embodiment

Figure 5:
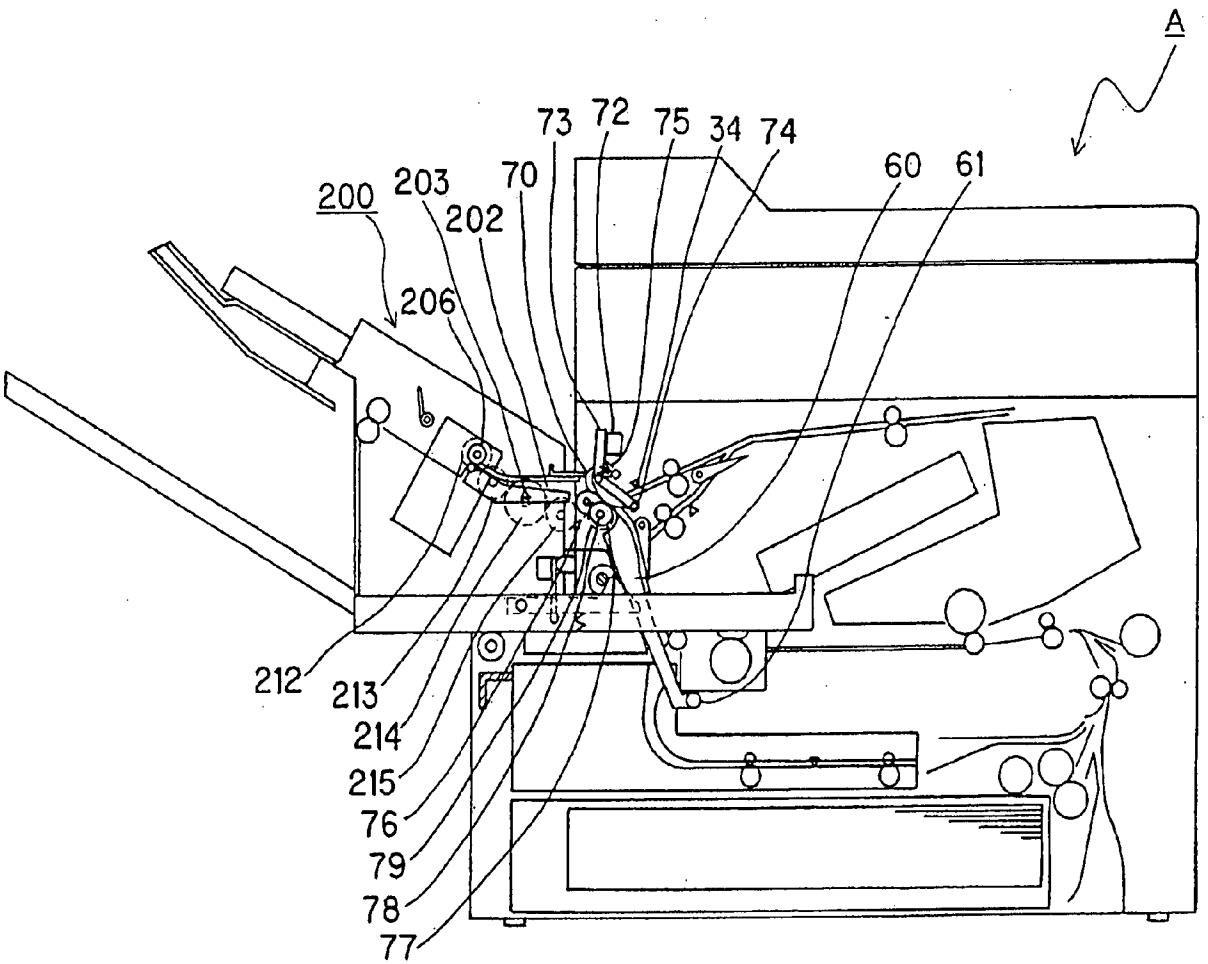
FIG. 5 is a schematic vertical cross-sectional view of an image forming apparatus and a sheet processing apparatus in accordance with second and third embodiments.

The following is a description of a case where the center distance between a pair of discharge rollers provided in an image forming apparatus is changed through driving force transmission from the driving source of a sheet processing apparatus. FIG. 5 illustrates the image forming apparatus in accordance with a second embodiment of the present invention. The same components as those of the first embodiment are denoted by the same reference numerals as those used for the first embodiment, and explanation of them is omitted.

As shown in FIG. 5, the image forming main body 1 and the staple stacker 200 are connected to each other, and the staple stacker 200 can operate properly. In this situation, a sheet S is conveyed from the image forming main body 1 to the staple stacker 200. At this point, an electric signal is transmitted from the image forming main body 1, and a motor (not shown) provided in the staple stacker 200 is activated. A pair of sheet-in rollers 206 then starts rotating so as to prepare for receiving the sheet S.

Here, gears 212, 213, 214, and 215 provided in the staple stacker 200 and arranged in the same driving force transmission line as the pair of sheet-in rollers 206 are engaged with a gear 76 provided in the image forming main body 1, thereby forming a driving force transmission unit. The gear 76 is engaged with an electromagnetic clutch 79. A cam 77 is attached to a shaft 78 that is coaxial with the electromagnetic clutch 79.

As the pair of sheet-in rollers 206 start rotating, driving force is transmitted to the gears 212, 213, 214, 215, and 76, as well as the electromagnetic clutch 79. The cam 77 is then rotated counterclockwise and is brought into contact with the upper discharge roller holding member 73. As a result, the upper discharge roller holding member 73 as the curvature providing portion is energized up, and rotates clockwise about the rotation center 74.

Rotating and moving to a predetermined position, the upper discharge roller holding member 73 comes into contact with an axial distance sensor switch 72, and the axial distance sensor switch 72 is turned ON. As the discharge roller holding member 73 reaches the predetermined position, the electromagnetic clutch 79 is activated by an electric signal transmitted from the axial distance sensor switch 72. The driving force transmission is then shut off, and the cam 77 stops rotating. As a result, the upper discharge roller 70 moves to such a position that the center distance becomes equal to the second center distance L2. Accordingly, the sheet stiffness of the sheet is changed, and the sheet exhibits almost a straight-line shape.

After the conveyance of the sheet S from the image forming main body 1 to the staple stacker 200, the electromagnetic clutch 79 resumes driving force transmission, and the cam 77 rotates counterclockwise to move away from the upper discharge roller holding member 73. At the same time, the upper discharge roller holding member 73 is energized by the biasing member 75, and rotates counterclockwise about the rotation center 74. As a result, the upper discharge roller 70 moves to such a predetermined position that the center distance between the discharge rollers 70 and 71 changes from the second center distance L2 to the first center distance L1. As described later, it is possible to transmit driving force from the staple stacker 200 to the image forming main body 1, every time a sheet S is conveyed from the image forming main body 1 to the staple stacker 200.

The staple stacker 200 then performs a series of post processing operations, in accordance with signals transmitted from the sheet-in sensor 203. As described above, with the driving force being given from the sheet processing apparatus, the driving force transmission unit provided in the image forming main body 1 can be minimized. Therefore, the image forming main body 1 does not need to include the components of the driving force transmission unit such as a driving force source as standard equipment, with the sheet processing apparatus being mounted as an option.

Although the electromagnetic clutch 79 is activated after the location of the upper discharge roller holding member 73 is detected in the second embodiment, the same effects as above can be achieved by activating the electromagnetic clutch 79 after detecting the phase of the cam 77. Also, in accordance with the second embodiment, the electromagnetic clutch 79 is designed to be coaxial with the cam 77. However, the same effect as above can also be achieved by placing the electromagnetic clutch 79 at any spot on the driving force transmission line from the sheet processing apparatus to the image forming apparatus.

Third Embodiment

Next, an image forming apparatus in accordance with a third embodiment of the present invention is described. In the third embodiment, the passing of a sheet is detected by an actuator provided in the image forming apparatus, and the center distance between the discharge rollers is then changed. In the following description, the same components as those of the first and second embodiments are denoted by the same reference numerals as those used in the first and second embodiments, and explanation of them is omitted.

As shown in FIG. 5, the staple stacker 200 is connected to the image forming main body 1, and the staple stacker 200 operates properly. As in the second embodiment, when a sheet S is conveyed from the image forming main body 1 to the staple stacker 200, an electric signal is transmitted from the image forming main body 1, and a motor (not shown) provided in the staple stacker 200 rotates. As in the second embodiment, the driving force transmission is shut off by the activation of the electromagnetic clutch 79, and the upper discharge roller 70 stops at a predetermined location. At this point, the center distance between the upper discharge roller 70 and the lower discharge roller 71 changes from the first center distance L1 to the second center distance L2. Accordingly, at the time of discharging, the shape of the sheet S changes to the substantially straight-line shape, as shown in FIGS. 2A and 2B.

The timing of activating the motor is determined in accordance with an electric signal transmitted when a sheet pass sensor 34 provided on the upper stream side of the discharge rollers 70 and 71 in the sheet conveying direction detects the passing of the sheet. The motor is activated by the electric signal transmitted when the passing of the sheet is detected, and the center distance between the upper discharge roller 70 and the lower discharge roller 71 is then changed. The reason of this procedure is as follows. If the biasing member 75 that energizes the upper discharge roller holding member 73 is left in a stretched state against the biasing force, the biasing force is reduced and the desired the extent of the sheet stiffness might not be maintained on each sheet. Therefore, the biasing member 75 should be stretched only when necessary, so as to prolong the service life of the biasing member 75.

When the sheet S passes through between the upper discharge roller 70 and the lower discharge roller 71, the electromagnetic clutch 79 resumes driving force transmission. The upper discharge roller holding member 73 is then energized by the biasing member 75, and rotates counterclockwise about the rotation center 74 to reach a predetermined location. As a result, the upper discharge roller 70 moves to such a location that the center distance changes from the second center distance L2 to the first center distance L1.

The staple stacker 200 then performs a series of post processing operations in accordance with signals transmitted from the sheet-in sensor 203.

Although the specific embodiments of the present invention have been described so far, the present invention is not limited to them, and various changes within the technical scope of the present invention can be made to those embodiments.

This application claims priority from Japanese Patent Application No. 2004-315924 filed Oct. 29, 2004, and Japanese Patent Application No. 2005-292662 filed Oct. 5, 2005, which is hereby incorporated by reference, herein.

What is claimed is:

1. An image forming apparatus to which a sheet processing apparatus that performs post processing on each sheet discharged from a main body of the image forming apparatus can be connected, the image forming apparatus comprising:

a discharge portion which discharges each sheet from the main body of the image forming apparatus; and a curvature providing portion which is located in the discharge portion and gives curvature to the sheet to be discharged, the curvature being directed in a direction perpendicular to the sheet discharging direction, the curvature providing portion being engaged with an engaging portion provided to the sheet processing apparatus, thereby reducing the curvature to be given to the sheet when the sheet processing apparatus is connected to the main body of the image forming apparatus.

2. The image forming apparatus according to claim 1, wherein the discharge portion comprises a pair of discharge rollers having a plurality of rotational members arranged so as to alternately face both sides of the sheet, and the curvature providing portion changes the center distance between the pair of discharge rollers so as to change the curvature to be provided to the sheet.

3. The image forming apparatus according to claim 2, further comprising:

a biasing member which applies a force to the pair of discharge rollers toward each other.

* * * * *